US006732959B2

(12) United States Patent
Delaney et al.

(10) Patent No.: US 6,732,959 B2
(45) Date of Patent: May 11, 2004

(54) DUAL-COIL OUTWARDLY-OPENING FUEL INJECTOR

(75) Inventors: John H. Delaney, Scottsville, NY (US); Joseph G. Spakowski, Rochester, NY (US); Noreen L. Mastro, Spencerport, NY (US); Robert B. Perry, Leicester, NY (US); Daniel L. Varble, Henrietta, NY (US); Kevin J. Allen, Avon, NY (US); Jay K. Sofianek, Webster, NY (US)

(73) Assignee: Delphi Technologies, Inc., Troy, MI (US)

( * ) Notice: Subject to any disclaimer, the term of this patent is extended or adjusted under 35 U.S.C. 154(b) by 38 days.

(21) Appl. No.: 10/234,285

(22) Filed: Sep. 4, 2002

(65) Prior Publication Data

US 2004/0041038 A1 Mar. 4, 2004

(51) Int. Cl.[7] ..... B05B 1/30

(52) U.S. Cl. ..... 239/585.1; 239/585.3; 239/585.5; 251/129.1

(58) Field of Search ..... 239/585.1, 585.2, 239/585.3, 585.5; 251/129.2, 129.09, 129.15, 129.16

(56) References Cited

U.S. PATENT DOCUMENTS 4,972,996 A * 11/1990 Cerny ..... 239/585.4
5,088,647 A * 2/1992 Yoshida et al. ..... 239/96
6,036,120 A 3/2000 Varble et al.
6,042,028 A 3/2000 Xu
6,065,684 A 5/2000 Varble et al.
6,209,805 B1 * 4/2001 Male et al. ..... 239/585.1
6,373,363 B1 * 4/2002 Spakowski et al. ..... 335/256
6,386,467 B1 * 5/2002 Takeda ..... 239/585.5

* cited by examiner

*Primary Examiner*—Dinh Q. Nguyen
(74) *Attorney, Agent, or Firm*—Patrick M. Griffin

(57) ABSTRACT

A dual-coil outwardly-opening fuel injector including a fuel tube connected at a lower end to a lower injector housing. Within the fuel tube are a lower (opening) solenoid pole piece, a specially-formed armature, and an upper (closing) solenoid pole piece. A seat assembly including an injector nozzle, swirler, and valve seat are adjustably threaded into the lower housing. A pintle assembly, including a solid pintle portion supporting a valve head and a tubular portion welded thereto, is axially disposed within the fuel tube and is welded to the armature which is spaced from the lower pole piece by a distance equal to the opening stroke of the valve. A return spring adjustment mechanism disposed on the upper pole piece engages the upper end of the pintle assembly for varying the closing force of the return spring. Opening and closing solenoid preassemblies are mounted external to the fuel tube for magnetically engaging the pole pieces and armature within in known fashion.

16 Claims, 2 Drawing Sheets

DUAL-COIL OUTWARDLY-OPENING FUEL INJECTOR

TECHNICAL FIELD

The present invention relates to direct injection fuel injectors; more particularly, to such fuel injectors having both opening and closing solenoid actuators; and most particularly, to such a fuel injector having reduced size, lower component cost, fewer assembly steps, lower material cost, single flow assembly, and external calibration.

BACKGROUND OF THE INVENTION

Outwardly-opening fuel injectors are well known for use in injecting fuel into the combustion cylinders of internal combustion engines. Such injection is known in the art as "direct injection" as opposed to "port injection" wherein fuel is injected into a manifold port upstream of the cylinder's intake valve.

An especially demanding use of direct injection is for injection of gasoline into spark-ignited internal combustion engines. Engine manufacturers are now recognizing that so-called "spray-guided" fuel injectors can be important factors in meeting fuel emission and fuel economy standards. Spray guided means that the fuel is injected into the combustion chamber and presented to the spark plug for ignition as an atomized fuel cloud having the proper location, size, and shape. The actual combustion chamber itself is not required to deflect, relocate, or prepare the fuel for ignition. For spray guided combustion, it is very important that the spray geometry remains consistent throughout a wide range of engine operating conditions. A known method of achieving the spray guided function is to cause the fuel injector to open outwardly into the firing chamber and to use the valve head to shape and direct the fuel exiting the injector.

U.S. Pat. Nos. 6,036,120, issued Mar. 14, 2000, and 6,065,684, issued May 23, 2000, are drawn to apparatus and method, respectively, for a direct injection fuel injector and are both incorporated herein by reference. The specifications are identical, and the two patents are treated here as a single disclosure. A high fuel pressure exerting an opening force is slightly overbalanced by a return spring tending to close the valve. A first solenoid acts to open the valve against the excess return spring force and a second solenoid acts to close the valve when the first solenoid is de-energized. Rapid valve closing is provided by energizing the second solenoid before de-energizing the first solenoid, the force of the second solenoid when the valve is open being insufficient to overcome the force of the first solenoid holding the valve open. Thus, the second solenoid magnetic force is fully developed and quickly closes the injection valve when the first solenoid is de-energized.

The prior art fuel injector has several drawbacks relating to final size, placement of the solenoids within the fuel flow path, and ease of assembly.

What is needed in the art is a dual-coil, outwardly-opening fuel injector having fewer components, solenoids outside a fuel tube, and which is easier to assemble.

It is a principal object of the present invention to reduce the size and cost of an improved dual-coil outwardly-opening fuel injector.

It is a further object of the present invention to simplify the assembly of such an improved fuel injector.

It is a still further object of the present invention to provide for external calibration of the return spring of such an improved fuel injector.

SUMMARY OF THE INVENTION

Briefly described, a dual-coil outwardly-opening fuel injector includes a fuel tube connected at a lower end to a lower injector housing. Within the fuel tube are a lower (opening) solenoid pole piece, a specially-formed armature, and an upper (closing) solenoid pole piece. A seat assembly including an injector nozzle, swirler, and valve seat are adjustably threaded into the lower housing. A pintle assembly, including a solid pintle portion supporting a valve head and a tubular portion-welded thereto, is axially disposed within the fuel tube and those components and is welded to the armature which is temporarily spaced from the upper pole piece by a distance equal to the opening stroke of the valve. The seat assembly is then turned into the lower housing, moving the armature away from the lower pole piece and into contact with the upper pole piece, thus setting the stroke of the valve. A return spring adjustment mechanism disposed on the upper pole piece engages the upper end of the pintle assembly for varying the closing force of the return spring. Opening and closing solenoid preassemblies are mounted external to the fuel tube for magnetically engaging the pole pieces and armature within in known fashion.

BRIEF DESCRIPTION OF THE DRAWINGS

The present invention will now be described, by way of example, with reference to the accompanying drawings, in which.

DESCRIPTION OF THE PREFERRED EMBODIMENTS

The novelty and advantages conferred by the invention may be better appreciated by first considering a prior art dual-coil outwardly-opening fuel injector.

Figure 1:
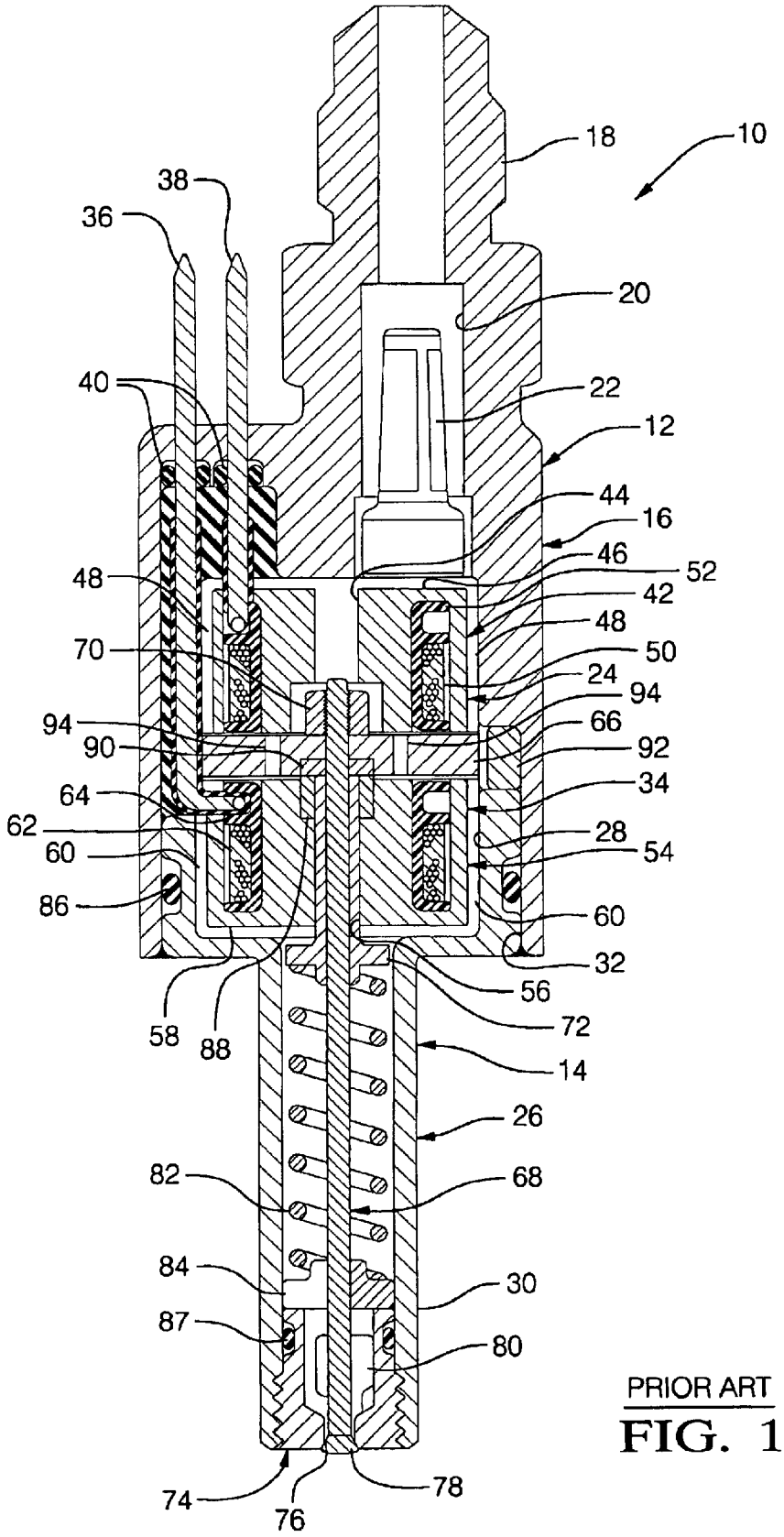
PRIOR ART FIG. 1
FIG. 1 is an elevational cross-sectional view of a prior art dual-coil outwardly-opening fuel injector.

Referring to FIG. 1, a prior art fuel injector 10, substantially the same as is disclosed in U.S. Pat. No. 6,065,684, is formed from two assemblies, including an upper housing assembly 12 and a lower housing assembly 14. The upper housing assembly 12 includes an upper housing 16 having an inlet defined by a threaded fuel fitting 18 and communicating through an inlet passage 20 containing a fuel filter 22 with a chamber or recess containing an upper solenoid assembly 24.

Lower housing assembly 14 includes a lower housing 26 having an enlarged upper portion 28 and a smaller diameter tubular lower portion 30. The upper portion has an outer diameter that is received in a generally cylindrical recess 32 formed in the lower portion of upper housing 16. A lower solenoid assembly 34 is received in an upwardly opening recess of the lower housing upper portion 28. Terminals 36,38 extend upward from the lower and upper solenoids 24,34 respectively through openings in the upper housing, 16 which are sealed by O-ring seals 40.

The upper solenoid assembly 24 includes a generally cylindrical upper soft (not permanently magnetized) magnetic pole 42 with a central axial passage 44 and a radial or transverse upper groove 46, both connecting with the fuel inlet passage 20. Groove 46 further connects with longitudinally extending external side grooves 48 leading to the lower end of the pole. An annular recess, opening to the lower end of pole 42, receives an upper solenoid coil 50 wound on a non-magnetic bobbin 52 having an annular upper groove for connection of the coil with its terminals 38.

The lower solenoid assembly 34 also includes a generally cylindrical lower soft magnetic pole 54 having an axial central bore 56 and a radial or transverse groove 58 across its lower side and connecting with external longitudinal side grooves 60 extending to the upper end of the pole. An upwardly opening annular recess in the pole 54 receives a lower solenoid coil 62 also wound on a non-magnetic bobbin 64 having an upper groove for connecting the coil through a slot in the side of the bobbin with the terminals 36 leading from the lower coil.

Located between the magnetic poles 42,54 is a disc-like armature 66 also formed of a soft magnetic material. The armature 66 has a central opening through which extends a pintle 68 having a retaining nut 70 threaded onto one end of the pintle. The nut 70 holds the armature 66 against the upper end of a tubular portion of a spring upper guide 72. The armature, 66, pintle 68, pintle nut 70, and guide 72 form an armature assembly, the parts of which are fixed together by the nut for movement in unison.

Guide 72 acts as a tubular valve guide for the upper end of the pintle 68 which extends therethrough and beyond to the lower end of the lower portion 30 of the lower housing 26. An injector nozzle 74 is threadably mounted in the lower end of lower portion 30 and has a centrally located outwardly opening conical valve seat 76 which is engageable by a conical valve element 78 formed on the lower end of the pintle which acts as a pintle valve. A swirl generator 80 is located around the pintle within the injector nozzle 74 defining therewith passages which impart a swirl motion to fuel passing therethrough toward the valve seat 76. The lower end of the spring upper guide 72 forms a spring seat for a helical return spring 82 which extends downward in the lower portion 30 of the lower housing to a lower spring guide 84 that seats against the injector nozzle 74. During assembly, the spring is compressed to the desired force and the upper guide 72 is then welded to the pintle to maintain the return spring force.

Additional components of the injector 10 include a housing seal 86 and an injector nozzle seal 87 to prevent leakage of fuel from the housing 16,18. The pintle retaining nut 70 is received in a recess in the lower end of the upper pole 42 and forming a part of the axial passage 44. A similar recess in the upper end of the lower pole 54 receives a hardened stop 88 which is engaged by an armature stop 90 to provide a predetermined gap or clearance between the armature 66 and the lower pole 54 when the stops are engaged. The armature stroke is set by turning the threaded nozzle 74 with the valve closed until the spacing of the armature from the stop 88 is equal to the desired stroke. A spacer ring 92 is located between the upper end of the lower housing 26 and a downwardly facing annular abutment in the recess 32 of the upper housing 16. The spacer ring 92 is sized longitudinally after setting the stroke to provide a predetermined clearance or gap between the armature and the upper magnetic pole when the valve 78 is closed. Relief holes 94 extend axially through armature 66 to prevent hydraulic damping of armature motion by the fuel in which it is immersed.

Prior art fuel injector 10 has a number of drawbacks which are overcome by the present invention. Injector 10 is cumbersome to assemble and calibrate. Because of normal manufacturing variability in dimensions of components, setting the stroke precisely and selecting the correct size for spacer ring 92 can require partial disassembly and reassembly of the injector, sometimes more than once. The fuel flow path is not via a single metal tube, as is known in the art of port-injection fuel injectors, and thus fuel may leak past seals 86 and 40; fuel is provided within a direct-injection fuel injector at pressures of, typically, about 1500 psi. Further, because the spring is welded to the pintle at a predetermined degree of compression, the spring force is not adjustable after assembly to accommodate various fuel pressures which may be encountered in different applications. The solenoids are built within the housings and are fully immersed in the fuel flowpath, which is undesirable and can be dangerous. In operation, armature 66 is subject simultaneously to opening and closing magnetic fields, with magnetic cross-over between the fields.

Figure 2:
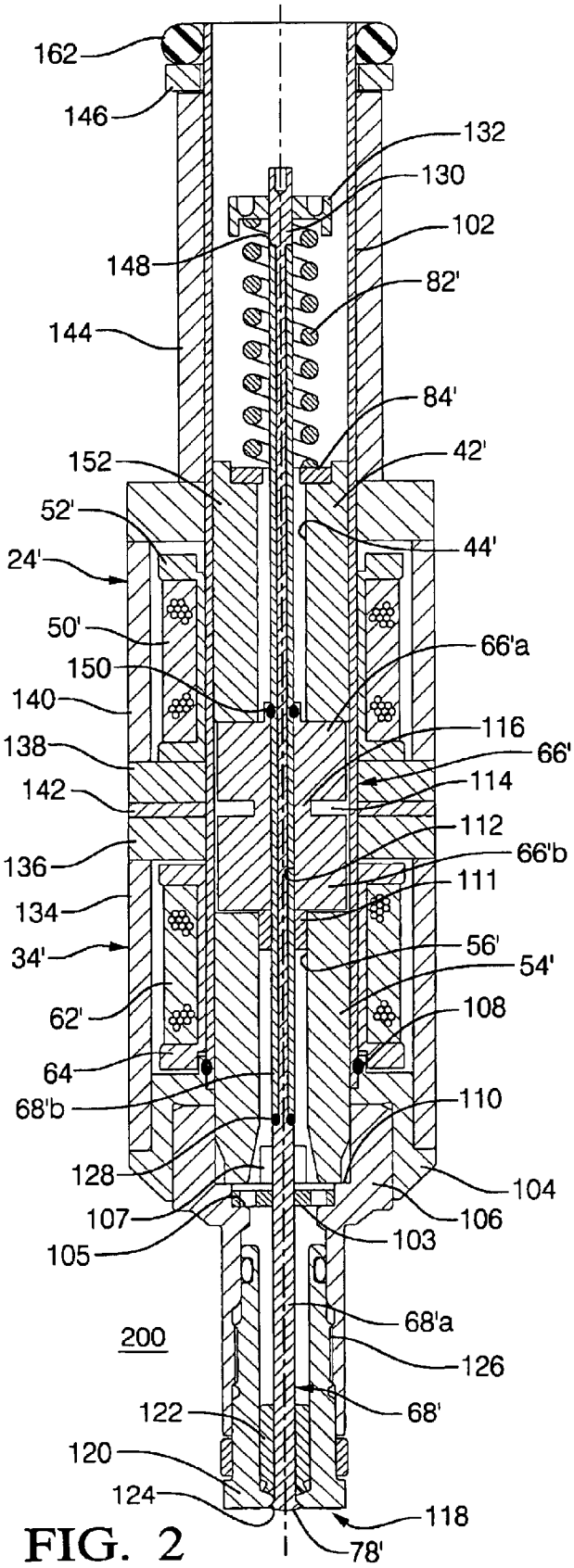
FIG. 2 is an elevational cross-sectional view of a novel dual-coil outwardly-opening fuel injector in accordance with the invention.

Referring to FIG. 2, components identical with or analogous to components shown in FIG. 1 are indicated by the same numbers primed. An improved dual-coil outwardly-opening fuel injector 10' in accordance with the invention, for use with an internal combustion engine 200, includes a main fuel tube 102, formed of a non-magnetic material such as stainless steel, which joins to lower housing components 104,106 via an annular weld 108. If desired, components 104,106 may be provided as a single element. The fuel flow path is completely contained within this structure and flows primarily along the inner wall of the tube outboard of the solenoid pole pieces as well as along the pintle assembly over a portion of the path. Within fuel tube 102, a disc-shaped pintle guide 103 is pressed into component 106 against first stop 105. Guide 103 has an axial bore for guiding a pintle as described below and also has axial passages for flow of fuel therethrough. Lower (opening) magnetic pole 54', having an axial bore 56', is pressed into housing component 106 against second stop 110.

A generally cylindrical armature 66' having an axial bore 112 is disposed within tube 102 adjacent pole 54'. Armature 66' preferably is formed as upper and lower armature elements 66'*a*,66'*b* having substantially identical first and second diameters, respectively, and separated by a washer-shaped air gap 114 and axially connected by a slim connector tube 116 having a third diameter less than the first and second diameters to minimize flux leakage between the upper and lower armature elements. Thus, the armature can function as a single element mechanically, responsive as a unit to both solenoids, but as two substantially separate elements magnetically, upper element 66'*a* being responsive to the closing solenoid and lower element 66'*b* being responsive to the opening solenoid, as described below.

An upper (closing) magnetic pole 42', having an axial bore 44', is disposed within tube 102 adjacent armature 66'. Ring-shaped spring seat 84' is disposed in a well in the upper end of pole 42' for receiving the lower end of return spring 82'.

A seat assembly 118 comprises injector nozzle 120, swirler 122, and pintle seat 124, substantially as disclosed in commonly-assigned U.S. Pat. No. 6,042,028 which is hereby incorporated by reference. Seat assembly 118 is threadedly received into element 103 via threads 126.

A pintle assembly 68' having a valve element 78' formed at the lower end is disposed axially within the assembly 10' as described thus far. Pintle assembly 68' preferably is formed of a solid portion 68'*a* and a tubular portion 68'*b* joined by a weld 128, thereby reducing weight and cost of the pintle. A threaded insert 130 is provided at the upper end of portion 68'*b* for receiving an adjustment nut 132' which also captures spring 82'.

Lower solenoid assembly 34' is preferably preassembled as a unit to be slid onto the outside of fuel tube 102 from the upper end. Assembly 34' includes a non-magnetic bobbin 64' supporting an opening coil 62', an opening coil body 134, and magnetic spacer 136.

Upper solenoid assembly 24' also is preferably preassembled as a unit to be slid onto the outside of fuel tube 102 from the upper end. Assembly 24' includes a magnetic spacer 138, a non-magnetic bobbin 52' supporting a closing coil 50', and a closing coil body 140. Preferably, upper solenoid assembly 24' is axially spaced apart from lower coil assembly 34' by a non-magnetic air gap washer 142 having a thickness equal to the height of air gap 114 in armature 66'. The solenoid assemblies are axially fixed to tube 102 as by adhesives or press fit in known fashion. Load tube 144 and backup ring 146 are disposed over fuel tube 102 and similarly attached. This arrangement transfers all axial load transients in the injector via an outer load shell comprising backup ring 146, load tube 144, spacers 136,138, coil bodies 134,140, gap washer 142, and lower elements 104,106. Thus, fuel tube 102 may be formed of quite thin stock, sufficient to withstand high fuel pressures but thin enough to permit excellent magnetic coupling between the solenoid assemblies 24',34', the opening and closing poles 42',54', and the armature 66'.

Improved injector 10' may be conveniently assembled as follows. Pintle guide 103 is pressed into lower housing component 106. Preassembled seat assembly 118 is threaded via threads 126 into component 106 to a stop, then backed out two turns to allow for later stroke adjustment. Lower pole 54' is inserted into the barrel of fuel tube 102 and cemented to stop 110. Pintle 68*a*' is welded to pintle tube 68'*b* at weld 128, and threaded insert 130 is welded to pintle tube 68'*b* at weld 148. Pintle assembly 68' is inserted into tube 102 via seat assembly 118. Armature 66' is lowered onto pintle assembly 68' until in contact with lower pole 54', the pintle valve being in the closed position, then is welded to pintle assembly 68' via weld 150. Upper pole 42' is inserted into the barrel of fuel tube 102 and is welded to the fuel tube via weld 152 at an axial location such that a gap exists between pole 42' and armature 66' equal in height to the intended stroke of the valve. Spring seat 84' is inserted onto upper pole 42'. Fuel tube 102 is welded to lower housing component 104 via weld 108. Seat assembly 118 then is turned into lower component 106 along threads 126, the valve being closed all the while, until armature 66' contacts upper pole 42' which acts as a stop for the armature. The armature is now free to move between the upper and lower poles by the height of the incorporated gap, which defines the open and closed positions of the valve.

Optionally, a pintle retainer 107 may be swaged onto pintle portion 68'*a* to prevent the pintle portion from exiting the seat assembly and damaging the associated engine if weld 128 fails.

Figure 3:
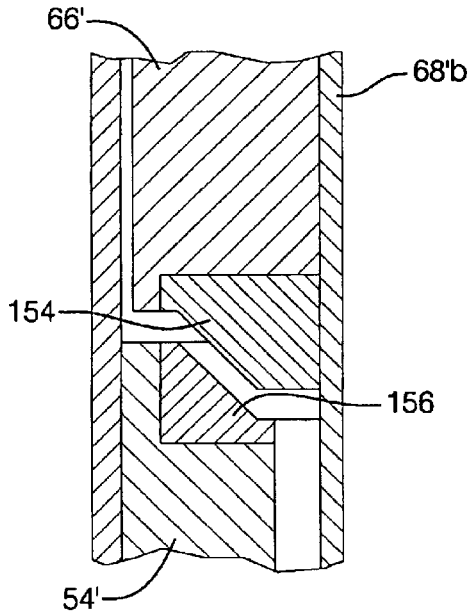
FIG. 3 is a detailed cross-sectional view of an optional embodiment of the armature and lower pole to include hardened, centering stops.

Optionally, a bushing 111 may be provided between pole 54' and pintle tube 68'*b* to retard displacement of fuel from between armature 66' and pole 54' during actuation of the injector, thus providing a hydraulic damper for impact of the armature against the pole. Alternatively, referring to FIG. 3, armature 66' and pole 54' may be provided with inserted stops 154,156, respectively, formed of a hard material, for example, carbide. Preferably such stops are tapered as shown to provide centering guidance of the armature/pintle assembly in meeting the lower pole.

Figure 4:
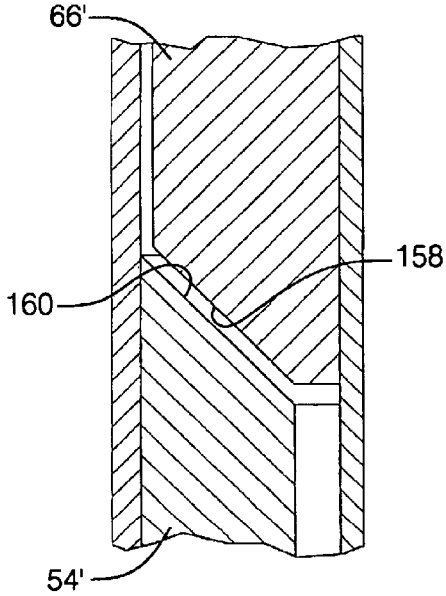
FIG. 4 is a cross-sectional view of an alternative embodiment of the armature and lower pole, showing tapered conical mating faces thereupon for shaping the opening magnetic field.

Referring to FIG. 4, the armature 66' and pole 54' may be provided with conically tapered mating faces, 158,160, respectively, which can desirably shape the valve-opening magnetic field to enhance the valve-opening time profile.

Referring again to FIG. 2, return spring 82' is installed onto spring seat 84' and is captured by nut 132. The expansive force of compressed spring 82' holds the valve closed against fuel pressure within the fuel tube. Thus, nut 132 may be advanced along threaded insert 130, as by a wrench through the open end of tube 102, to progressively compress spring 82' and provide any desired amount of closing force as required by a specific injector use.

Solenoid assemblies 34', 24', washer 142, load tube 144, and backup ring 146 are installed over fuel tube 102 as described above. Improved fuel injector assembly 10' may be fitted conventionally to a fuel rail and sealed thereto via O-ring 148, or alternatively it may be provided with a threaded nipple attachment 18 as shown for prior art injector 10 in FIG. 1.

In operation, improved fuel injector 10' functions substantially identically with prior art fuel injector 10. However, the manufacturing benefits of the invention are readily seen in a comparison of manufacturing costs, steps, and components between prior art injector 10 and improved injector 10':

| | Injector 10 | Injector 10' |
|---|---|---|
| Process steps | 72 | 37 |
| Hermetic welds | 6 | 3 |
| Number of components | 38 | 21 |
| Cost of materials | X | 0.5X |

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel injector for injecting fuel into an internal combustion engine, comprising:

a) a lower housing element;

b) a fuel tube received in said lower housing element for receiving and conveying fuel from a pressurized source;

c) a seat assembly received in said lower housing element, including an injector nozzle and an injector valve seat receivable of fuel from said fuel tube;

d) a first solenoid pole piece disposed in said fuel tube;

e) a second solenoid pole piece disposed in said fuel tube;

f) an armature disposed in said fuel tube between said first and second pole pieces;

g) a pintle including a valve head axially disposed in said seat assembly and said fuel tube and attached to said armature;

h) a first solenoid assembly disposed around said fuel tube adjacent said first pole piece for opening said injector valve to dispense fuel from said injector; and i) a second solenoid assembly disposed around said fuel tube adjacent said second pole piece for closing said injector valve.

2. A fuel injector in accordance with claim 1 further comprising:

a) a return spring disposed adjacent said second pole piece and surrounding said pintle, said pintle extending beyond said second pole piece; and b) adjusting means disposed in said fuel tube and engaging of said pintle and spring to adjust the compression of said spring against said second pole piece.

3. A fuel injector in accordance with claim 2 wherein said adjusting means is accessible from outside said fuel injector to perform said adjusting of said spring compression.

4. A fuel injector in accordance with claim 1 further comprising a load tube disposed around said fuel tube adjacent said second solenoid assembly.

5. A fuel injector in accordance with claim 1 further comprising a non-magnetic washer disposed between said first and second solenoid assemblies.

6. A fuel injector in accordance with claim 1 further comprising a damping bushing disposed between said first pole piece and said pintle.

7. A fuel injector in accordance with claim 1 wherein said seat assembly is attached to said lower housing element by threads to permit relative axial motion therebetween.

8. A fuel injector in accordance with claim 7 wherein the stroke length of the injector is adjustable by rotation of said seat assembly within said lower housing element.

9. A fuel injector in accordance with claim 1 wherein said armature and said first pole piece are each provided with mating inserted stops on opposed surfaces thereof.

10. A fuel injector in accordance with claim 1 wherein said armature and said first pole piece are each provided with mating conically tapered surfaces for cooperatively shaping a valve-opening magnetic field.

11. A fuel injector in accordance with claim 1 further provided with means for engaging with a source of pressurized fuel.

12. A fuel injector in accordance with claim 11 wherein said fuel is selected from the group consisting of gasoline and diesel fuel.

13. A fuel injector in accordance with claim 1 wherein said injector is suited for direct injection of fuel into an engine's combustion chamber.

14. A fuel injector in accordance with claim 1 wherein said armature comprises:

a) a first element magnetically responsive to said first solenoid assembly and having a first diameter;

b) a second element magnetically responsive to said second solenoid assembly and having a second diameter and being spaced apart from said first element; and c) a tubular connector having a third diameter less than said first and second diameters and axially connecting said first and second elements.

15. An internal combustion engine, comprising a fuel injector including a lower housing element, a fuel tube received in said lower housing element for receiving and conveying fuel from a pressurized source, a seat assembly received in said lower housing element, including an injector nozzle and an injector valve seat receivable of fuel from said fuel tube, a first solenoid pole piece disposed in said fuel tube, a second solenoid pole piece disposed in said fuel tube, an armature disposed in said fuel tube between said first and second pole pieces, a pintle including a valve head axially disposed in said seat assembly and said fuel tube and attached to said armature and extending beyond said second pole piece, a return spring disposed adjacent said second pole piece and surrounding said pintle, adjusting means disposed in said fuel tube and engaging of said pintle and spring to adjust the compression of said spring against said second pole piece, a first solenoid assembly disposed around said fuel tube adjacent said first pole piece for opening said injector valve to dispense fuel from said fuel injector, and a second solenoid assembly disposed around said fuel tube adjacent said second pole piece for closing said injector valve.

16. An armature for a dual-coil fuel injector having first and second solenoid assemblies, comprising:

a) a first element magnetically responsive to said first solenoid assembly and having a first diameter;

b) a second element magnetically responsive to said second solenoid assembly and having a second diameter and being spaced apart from said first element; and c) a tubular connector having a third diameter less than said first and second diameters and axially connecting said first and second elements.

* * * * *